US010991563B2

(12) United States Patent
Vestal et al.

(10) Patent No.: US 10,991,563 B2
(45) Date of Patent: Apr. 27, 2021

(54) MOLECULAR IMAGING OF BIOLOGICAL SAMPLES WITH SUB-CELLULAR SPATIAL RESOLUTION AND HIGH SENSITIVITY

(71) Applicant: Virgin Instruments Corporation, Marlborough, MA (US)

(72) Inventors: Marvin L. Vestal, Framingham, MA (US); Kevin Hayden, Newton, MA (US)

(73) Assignee: Virgin Instruments Corporation, Marlborough, MA (US)

( * ) Notice: Subject to any disclaimer, the term of this patent is extended or adjusted under 35 U.S.C. 154(b) by 0 days.

(21) Appl. No.: 16/552,148

(22) Filed: Aug. 27, 2019

(65) Prior Publication Data

US 2020/0075304 A1 Mar. 5, 2020

Related U.S. Application Data

(60) Provisional application No. 62/723,597, filed on Aug. 28, 2018.

(51) Int. Cl.

| | |
|---|---|
| ***H01J 49/00*** | (2006.01) |
| ***H01J 49/16*** | (2006.01) |
| ***H01J 49/40*** | (2006.01) |

(52) U.S. Cl.

CPC ..... *H01J 49/164* (2013.01); *H01J 49/0004* (2013.01); *H01J 49/40* (2013.01); *H01J 49/005* (2013.01)

(58) Field of Classification Search

CPC ..... H01J 49/00; H01J 49/02; H01J 49/0004; H01J 49/0027; H01J 49/0031; H01J 49/164; H01J 49/0418; H01J 49/26; H01J 49/40

(Continued)

(56) References Cited

U.S. PATENT DOCUMENTS 6,423,966 B2 * 7/2002 Hillenkamp ..... H01J 49/0418 250/288

9,543,138 B2 1/2017 Vestal et al.

(Continued)

FOREIGN PATENT DOCUMENTS

JP 2010-251174 A 11/2010

OTHER PUBLICATIONS

"Notification of Transmittal of the International Search Report and the Written Opinion of the International Searching Authority, or the Declaration" for International Patent Application No. PCT/US2019/048280, dated Dec. 16, 2019, 10 pages, ISA/KR, Korean Intellectual Property Office, Daejeon, Republic of Korea.

(Continued)

*Primary Examiner* — Jason L McCormack

(74) *Attorney, Agent, or Firm* — Rauschenbach Patent Law Group, LLC; Kurt Rauschenbach

(57) ABSTRACT

An apparatus for molecular imaging of biological samples includes a first optical port configured to receive a first pulsed optical beam that is directed in an optical path along an optical axis. A transparent target that include a first surface having an electrically conductive surface that supports a biological sample under analysis and a second surface is positioned in the optical path along the optical axis. A moveable target mount is configured to translate the transparent target to a plurality of predetermined locations. A first optical focusing element is configured to focus the first pulsed optical beam to a first predetermined diameter at the first surface of the transparent target. A second optical port is configured to receive a second pulsed optical beam that is directed in a second optical path along the optical axis. A second optical focusing element is configured to focus the second pulsed optical beam to a second predetermined diameter at the electrically conductive surface on the (Continued)

transparent target. A TOF mass spectrometer comprising an ion accelerator having a central axis that is substantially coaxial with the optic axis so that ions generated by the first and second pulsed optical beams are accelerated by the ion accelerator. A controller instructs the TOF mass spectrometer to acquire mass spectral data at the plurality of predetermined locations, thereby generating a molecular image of the biological sample under analysis.

36 Claims, 4 Drawing Sheets

(58) Field of Classification Search
USPC ..... 250/281, 282, 287, 288
See application file for complete search history.

(56) References Cited

U.S. PATENT DOCUMENTS

| | | | | |
|---|---|---|---|---|
| 2010/0213367 | A1* | 8/2010 | Miller | H01J 49/0463 250/282 |
| 2019/0180996 | A1* | 6/2019 | Loboda | H01J 49/105 |
| 2019/0252171 | A1* | 8/2019 | Barborini | C01G 23/047 |

OTHER PUBLICATIONS

Yunsheng Hsieh, et al., Mapping Pharmaceuticals in Tissues Using MALDI Imaging Mass Spectrometry, Journal of Pharmacological and Toxicological Methods, Apr. 1, 2007, vol. 55, Issue 2, pp. 193-200.

Andre Zavalin, et al., Direct Imaging of Single Cells and Tissue at Sub-Cellullar Spatial Resolution Using Transmission Geometry MALDI MS, Journal of Mass Spectrometry, Nov. 12, 2012, pp. 1473-1477, vol. 47, Issue 11.

Adam D. Feenstra, et al., Five Micron High Resolution MALDI Mass Spectrometry Imaging with Simple, Interchangeable, Multi-Resolution Optical System, Journal of the American Society for Mass Spectrometry, Jan. 3, 2007, pp. 434-442, vol. 28.

Andre Zavalin, et al., Tissue Protein Imaging at 1 μm Laser Spot Diameter for High Spatial Resolution and High Imaging Speed Using Transmission Geometry MALDI TOF MS, Anal Bioanal Chem, vol. 407, No. 8, Mar. 2015, pp. 2337-2342.

"Notification Concerning Transmittal of International Preliminary Report on Patentability (Chapter I of the Patent Cooperation Treaty)" for International Patent Application No. PCT/US2019/048280, dated Mar. 11, 2021, 7 pages, The International Bureau of WIPO, Geneva, Switzerland.

* cited by examiner

MOLECULAR IMAGING OF BIOLOGICAL SAMPLES WITH SUB-CELLULAR SPATIAL RESOLUTION AND HIGH SENSITIVITY

RELATED APPLICATION SECTION

The present application is a non-provisional of U.S. Provisional Patent Application Ser. No. 62/723,597, filed Aug. 28, 2018, and entitled "Method and Apparatus for Molecular Imaging of Biological Samples with Sub-Cellular Spatial Resolution and High Sensitivity". The entire contents of U.S. Patent Application Ser. No. 62/723,597 are incorporated herein by reference.

INTRODUCTION

Mass Spectrometry Imaging (MSI) can be used to provide a spatial distribution of molecules identified by their molecular masses. Mass spectra are taken at different positions on a sample until the entire sample is scanned at a predetermined position interval. Particular peaks in the resulting spatially distributed spectra that correspond to a compound of interest provide a map of the compound's distribution across the sample. Spatial resolution of the image is related to the spot size of each mass spectrum measurement.

The mass spectrum generally yields both qualitative and quantitative information about the sample. In addition, the mass spectrometry is capable of detecting biomolecules of virtually every class, including proteins, nucleic acids, lipids, carbohydrates, and metabolites. A mass spectrum can include tens to hundreds of unique detected ions. For example, one mass spectral image can correlate images for hundreds of unique compounds.

Mass spectrometry imaging has been extensively applied to biological and clinical research. In addition, mass spectrometry imaging has been applied to the visualization of lipid distributions and classification of diseased tissue states. Broader application of this powerful analysis technique demands further improvement of methods and apparatus for mass spectrometry imagers.

BRIEF DESCRIPTION OF THE DRAWINGS

The present teaching, in accordance with preferred and exemplary embodiments, together with further advantages thereof, is more particularly described in the following detailed description, taken in conjunction with the accompanying drawings. The skilled person in the art will understand that the drawings, described below, are for illustration purposes only. The drawings are not necessarily to scale, emphasis instead generally being placed upon illustrating principles of the teaching. The drawings are not intended to limit the scope of the Applicant's teaching in any way.

DESCRIPTION OF VARIOUS EMBODIMENTS

Figure 1:
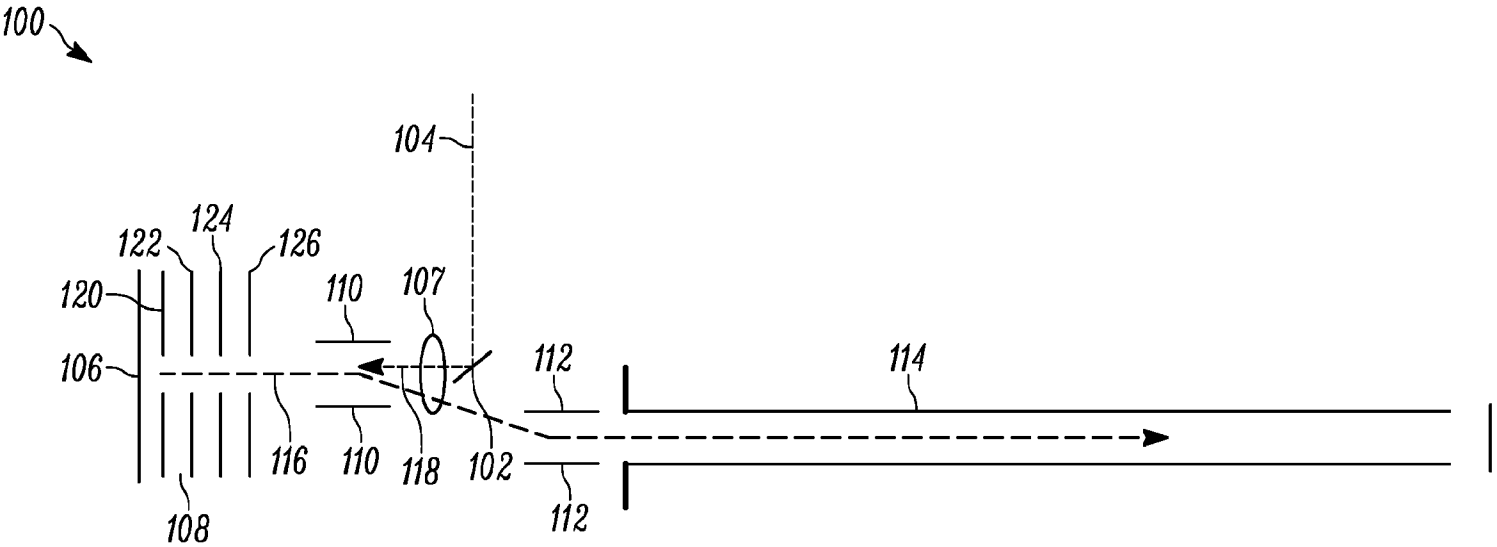
FIG. 1 illustrates a schematic diagram of an embodiment of ion optics employed in the high-spatial-resolution mass spectral imaging apparatus according to the present teaching.

The present teaching will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications and equivalents, as will be appreciated by those of skill in the art. Those of ordinary skill in the art having access to the teaching herein will recognize additional implementations, modifications, and embodiments, as well as other fields of use, which are within the scope of the present disclosure as described herein.

Reference in the specification to "one embodiment" or "an embodiment" means that a particular feature, structure, or characteristic described in connection with the embodiment is included in at least one embodiment of the teaching. The appearances of the phrase "in one embodiment" in various places in the specification are not necessarily all referring to the same embodiment.

It should be understood that the individual steps of the methods of the present teachings can be performed in any order and/or simultaneously as long as the teaching remains operable. Furthermore, it should be understood that the apparatus and methods of the present teachings can include any number or all of the described embodiments as long as the teaching remains operable.

Mass spectrometry imaging is a technology that produces ion maps or images from the direct desorption of molecules from cells in tissues. See, for example, Caprioli, R. M., Farmer, T. B., Gile, J., "Molecular Imaging of Biological Samples: Localization Of Peptides and Proteins Using MALDI-TOF MS," Anal Chem., 1997, 69 (23): 4751-4760. Standard commercial instruments that ablate cellular material using lasers which irradiate the topside of the tissue or other biological sample routinely achieve spatial resolutions of up to about 20 μm. To realize laser spot sizes of 5 μm or less on a target that includes the sample of interest, an ion source for MSI sometimes referred to as "transmission geometry" that irradiates the tissue or other sample from the backside has been developed. See, for example, Wei, H., Nolkrantz, K., Powell, D. H., Woods, J. H., Ko, M. C., Kennedy, R. T., "Electrospray Sample Deposition For Matrix-Assisted Laser Desorption/Ionization (MALDI) and Atmospheric Pressure MALDI Mass Spectrometry with Attomole Detection Limits," Rapid Communications in Mass Spectrometry, 2004, 18 (11): 1193-1200. While this "transmission geometry" approach can improve spatial resolution, additional features are required to provide a high-sensitivity, practical MSI system for high-resolution imaging. For example, improvements are needed to achieve sufficient resolution to realize subcellular imaging. In addition, systems need to operate with high speed and to be sufficiently automated to support high-quality imaging with minimum operator intervention. The present teaching provides an apparatus and method for irradiating samples from both front and back with laser generated optical beams with small diameter. For example, some embodiments produce optical beams with minimum diameters substantially equal to the diffraction limit of twice the laser wavelength. More-over, some embodiments of the present teaching provide high sensitivity for MALDI-TOF imaging from single laser shots of each laser for each pixel in the image. These and other features of the present teaching make imaging at sub-cellular levels practical for the first time.

Matrix Assisted Laser Desorption Ionization (MALDI) based analysis is one of the most widely used ionization methods in biological mass spectrometry (MS). Matrix Assisted Laser Desorption Ionization incorporates analyte molecules into a matrix of organic material and then irradiates the sample with a focused optical beam, typically generated by a laser that operates either continuously or in a pulsed mode. Absorption of the laser energy by the matrix leads to desorption of the analyte molecules and their ionization, often by gas-phase protonation or deprotonation reactions. The ions are typically analyzed using time-of-flight (TOF) measurements. Matrix Assisted Laser Desorption Ionization MS has been effectively applied for analysis of proteins, peptides, lipids, DNA, and RNA. Matrix Assisted Laser Desorption Ionization MS performance features include high sensitivity, high impurity tolerance during analysis of complex mixtures, and ease of sample preparation.

Mass Spectrometry Imaging can be described as a set of MS profiling measurements performed at an ordered array of locations across a surface of a sample. Matrix Assisted Laser Desorption Ionization MS microanalysis techniques have been shown to yield important information regarding single-cell function, for example, in mammalian cells and microbes. Even absolute quantitation is possible at the level of a few cells or even a single cell using various methods, including, for example, isotopic labeling, succinic anhydride labeling and standard addition. Contents of micron-sized organelles can be profiled using similar bioanalytical techniques. With proper techniques, MALDI MSI profiling could become a powerful tool for biological analysis at the subcellular level.

Prior art MALDI MSI systems have been limited by the laser focusing and sample preparation methods that restrict the ability to achieve subcellular resolution. In a typical MALDI MSI analysis, the optical beam generated by the laser is rastered across a sample. Recently, MALDI MSI is being performed at cellular length scales that can be defined as scales on the order of few-micron-scale resolution or less. A few-micron-scale measurement pixel provides approximately cell-per-pixel resolution. Such resolution requires focus of the optical beam microprobe to submicron diameters and high laser fluence such that adequate amounts of analytes are ionized in small sample areas.

Spatial resolutions of up to about 20 μm can be achieved using lasers that irradiate the front-side of the tissue with standard sample preparation. Techniques for sample preparation have been developed that can improve the spatial resolution to about 10 μm, but prospects for further improvement in spatial resolution are limited. In some systems, the first step for imaging of proteins is to wash the sample surface with organic solvent to remove lipids. The MALDI matrix is then deposited either by spraying or by sublimation. In both cases, it is necessary to restrict wetting of the surface to avoid spreading of proteins on the surface. These techniques provide relatively high spatial resolution but only a small fraction of the proteins on the surface are incorporated into crystals and are subsequently detected by MALDI-TOF. It is possible to further reduce the laser diameter to ca, 1 μm, but the number of molecules per pixel incorporated into the crystals becomes so small that the sensitivity for analysis of proteins is inadequate.

Also, with front-side irradiation, the desorbed sample is limited to a very thin layer that is incorporated into matrix crystals. In some methods, the layer may be only a monolayer thick. However, in many cases, the layer is no more than 10 nm in thickness. For a tissue sample, this implies that less than 0.1% of the total sample is ionized and detected even though the matrix provides a large supply of reagent ions.

Back-side irradiation has several advantages in imaging applications. For example, back-side irradiation allows high spatial resolution with optical beam sizes on target approaching the wavelength of the laser. The ion optics are spatially separated from the laser optics, which makes it possible to optimize both ion and optical beams independently which can be used to achieve high sensitivity. The transmission geometry laser desorption ionization (LDI) source for non-imaging MS applications was initially introduced by Fenner and Daly. See, for example, Wei H, Nolkrantz K, Powell D H, Woods J H, Ko MOPTICAL BEAMC, Kennedy R T, "Electrospray Sample Deposition for Matrix-Assisted Laser Desorption/Ionization (MALDI) and Atmospheric Pressure MALDI Mass Spectrometry With Attomole Detection Limits," Rapid Communications in Mass Spectrometry, 2004; 18 (11):1193-1200. This technology was improved by the Hillenkamp group. Experimental results were obtained using a LAMMA 500 instrument (Leybold-Heraeus GmbH, Keln, Germany). See, for example, Qiao, H., Spicer, V., Ens, W., "The Effect of Laser Profile, Fluence, and Spot Size on Sensitivity in Orthogonal-Injection Matrix-Assisted Laser Desorption/Ionization Time-Of-Flight Mass Spectrometry," Rapid Communications in Mass Spectrometry, 2008, 22 (18): 2779-2790. A sub-micron laser spot size was achieved in this scheme at 266 nm wavelength. Although the apparatus played an important role in establishing the transmission geometry of LDI sources, this particular apparatus was not readily applicable to imaging applications.

For imaging MS applications, a transmission geometry vacuum MALDI source was built in Caprioli Laboratory on a modified AB4700 MALDI instrument (Applied Biosystems/Thermo Fisher Scientific, Waltham, Mass., USA). See for example, Zavalin, A., Todd, E. M., Rawhouser, P. D., Yang, J. H., Norris, J. L., Caprioli, R. M., "Direct Imaging of Single Cells and Tissue at Sub-Cellular Spatial Resolution Using Transmission Geometry MALDI MS," Journal of Mass Spectrometry, 2012, 47 (11):1473-1481. Also see, for example, Thiery-Lavenant, G., Zavalin, A. I., Caprioli, R. M., "Targeted Multiplex Mass Spectrometry Imaging in Transmission Geometry for Subcellular Spatial Resolution," Journal of the American Society for Mass Spectrometry, 2013, 24 (4): 609-614. The laser focusing microscope objective in this source is placed in vacuum, but the residual part of the optical configuration is mounted outside of the sample chamber. This apparatus can provide submicron spatial resolution MALDI mass spectrometry imaging at 349 nm laser wavelength which has been demonstrated for various tissue types and single cells. See for example, Zavalin, A., Todd, E. M., Rawhouser, P. D., Yang, J. H., Norris, J. L., Caprioli, R. M., "Direct Imaging of Single Cells and Tissue at Sub-Cellular Spatial Resolution Using Transmission Geometry MALDI MS," Journal of Mass Spectrometry, 2012, 47 (11):1473-1481. Protein imaging mass spectrometry capability was achieved at sub-cellular spatial resolution using a 1 μm laser spot using a transmission geometry ion source. See, for example, Zavalin, A., Yang, J., Hayden, K., Vestal, M., Caprioli, R M., "Tissue Protein Imaging at 1 μm Laser Sport Diameter for High Spatial Resolution and High Imaging Speed Using Transmission Geometry MALDI TOF MS," Anal Bioanal Chem., 2015 March, 407(8), 2337-2342.

Back-side illumination of a tissue 10 μm thick may result in vaporization of essentially the entire sample irradiated, but the production of reagent ions from the front side may be weak. Consequently, the ionization efficiency from the back-side illumination may be low. In some embodiments, the methods and apparatus of the present teaching employ back-side irradiation to energize and vaporize the sample and front-side irradiation to produce intense reagent ions to efficiently ionize the sample molecules.

One feature of the method and apparatus of the present teaching is the ability to achieve subcellular spatial resolution using mass spectrometry imaging with high acquisition speed. The method and apparatus for high-spatial-resolution molecular imaging according to the present teaching integrates a transmission geometry ion source with time-of-flight mass spectrometry. The transmission geometry principle allows, for example, a 1 μm laser spot diameter on target. In one embodiment, a minimal raster step size of the apparatus is 2.5 μm. Use of 2,5-dihydroxyacetophenone robotically sprayed on top of a tissue sample as a matrix together with additional sample preparation steps can result in single pixel mass spectra from mouse cerebellum tissue sections having more than 20 peaks in a range 3-22 kDa. Mass spectrometry images were acquired in a standard step raster microprobe mode at 5 pixels/s and in a continuous raster mode at 40 pixels/s.

Another feature of the present teaching is that high-sensitivity subcellular resolution can be obtained with an apparatus designed for manufacture using the method and apparatus of the present teaching with an appropriate design of ion optics and ionizing optical beam directing and focusing elements. A variety of ion optics configurations can be used in the apparatus of the present teaching. See, for example, U.S. Pat. No. 9,543,138 entitled Ion Optical System for MALDI-TOF Mass Spectrometer that issued Jan. 10, 2017. U.S. Pat. No. 9,543,138 is assignment to the present assignee and is incorporated herein by reference.

FIG. 1 illustrates a schematic diagram of an embodiment of ion optics 100 employed in the high-spatial-resolution mass spectral imaging apparatus according to the present teaching. An optical beam directing element 102 directs an optical beam 104 toward a target 106. The optical beam 104 may be focused by a focusing element 107 to form a small spot size at or near the target 106. The optical beam 104 illuminates a sample of interest on the target 106 to generate ions that are guided by the ion optics 100 for analysis in a MALDI-TOF mass spectrometer. In some embodiments, the target 106 comprises a slide with a biological sample and a layer of MALDI matrix. In other embodiments, the target 106 comprises a sample plate with a biological sample and a layer of MALDI matrix.

The ion optics 100 include an ion accelerator 108, a first set of deflection electrodes 110, a second set of deflection electrodes 112, and a field-free evacuated drift region 114. The ion accelerator 108 includes a bias electrode 120, an extraction electrode 122, a focus electrode 124, and a source exit acceleration electrode 126. A central axis 116 of the ion accelerator 108 runs through the nominal center of the electrodes comprising the acceleration 108. The optical beam directing element 102 is positioned to project the optical beam 104 along an axis 118 that is directed to the target 106. The system is configured such that the central axis 116 of the ion accelerator 108 and the axis 118 of the projected optical beam 104 are coaxial. In some embodiments, the central axis 116 of the ion accelerator 108 and the axis 118 of the projected optical beam 104 are perpendicular to the target 106. That is, the normal to the plane that contains the target 106 is parallel to the axes of the accelerated and projected optical beam 104.

Figure 2:
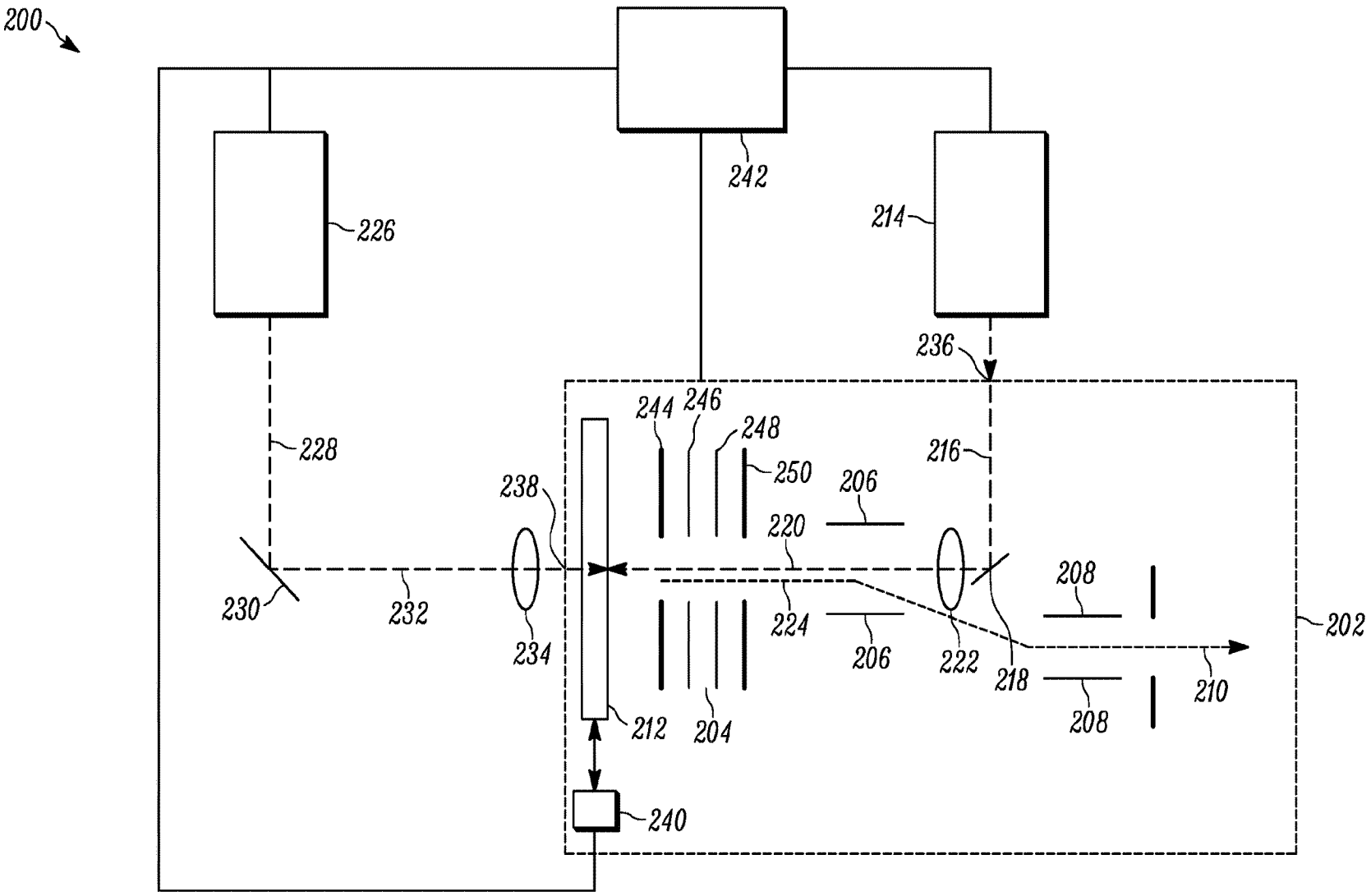
FIG. 2 illustrates a schematic diagram of an embodiment of a high-spatial-resolution mass spectral imaging apparatus according to the present teaching.

FIG. 2 illustrates a schematic diagram of an embodiment of a high-spatial-resolution mass spectral imaging apparatus 200 according to the present teaching. A MALDI-TOF mass spectrometer 202 is shown with ion optics similar to those described in connection with FIG. 1. The ion optics include an ion accelerator 204, a first set of deflection electrodes 206, a second set of deflection electrodes 208, and a field-free evacuated drift region 210. The ion accelerator 204 includes a bias electrode 244, an extraction electrode 246, a focus electrode 248, and a source exit acceleration electrode 250.

The MALDI-TOF mass spectrometer 202 includes a target 212. For example in some embodiments, the target 212 comprises a conductive slide. The target 212 includes a biological sample and a layer of MALDI matrix. In some embodiments, the target 212 comprises an optically transparent slide with at least one side being electrically conductive. Also, in some embodiments, a thin film of biological sample of interest is attached to the electrically conductive side of the slide and a layer of MALDI matrix material is deposited onto the biological sample. In some embodiments, a layer of MALDI matrix is deposited on an electrically conductive side of a slide and the biological sample is deposited onto the surface of said MALDI matrix. In some embodiments, the target 212 comprises a sample plate with a biological sample and a layer of MALDI matrix.

A laser 214 generates an optical beam 216 that illuminates the sample on the target 212. In various embodiments, the laser 214 is a continuous wave laser or a pulsed laser. The optical beam 216 is projected by a beam directing element 218 that projects the optical beam 216 along an axis 220 toward the target 212. A focusing element 222 is used to focus the optical beam 216. The focusing element 222 is chosen to provide a predetermined optical beam diameter at the target 212. In some embodiments, the beam directing element 218 is a mirror. In some embodiments, focusing element 222 is a lens. A variety of known beam directing elements 218 and focusing elements 222 can be used to project the optical beam along a particular desired axis and to provide a desired predetermined optical beam diameter at the target 212. For example, one or more elements may be used for each of the beam directing elements 218 and/or focusing elements 222. In addition, the beam directing element 218 and focusing element 222 can be the same element. For example, the beam directing element 218 and the focusing element 222 can comprise a curved mirror.

A central axis 224 of the ion accelerator 204 runs through the nominal center of the ion accelerator 204. The optical beam directing element 218 is positioned to project the optical beam 216 along an axis 220 that is directed to the target 212. The system is configured such that the central axis 224 of the ion accelerator 204 and the axis 220 of the projected optical beam 216 are coaxial. In some embodiments the central axis 224 of the ion accelerator 204 and the axis 220 of the projected optical beam 216 are perpendicular to the target 212. That is, the normal to the plane that contains the target 212 is parallel to the central axes 224 and to the axis 220 of the ion accelerator and projected optical beam.

A second laser 226 generates an optical beam 228 used for backside illumination of the biological sample. The optical beam 228 is projected by an optical beam directing element 230 that projects the optical beam 228 along an axis 232 toward the target 212. A focusing element 234 is used to focus the optical beam 228 to a small spot of a predetermined beam diameter at the target 212. In some embodiments, the optical beam directing element 230 is a mirror. In some embodiments, focusing element 234 is a lens. A variety of known beam directing elements 230 and focusing elements 234 can be used to project the optical beam along a desired particular axis and to provide a desired predetermined optical beam diameter at the target 212 as described above in connection with the description of the beam directing element 218 and the focusing element 222.

The optical beams 216, 228 enter the MALDI-TOF mass spectrometer 202 via ports 236, 238. In the embodiment shown in FIG. 2, beam directing element 230 and focusing element 234 are outside of the MALDI-TOF mass spectrometer 202. Beam directing element 218 and focusing element 222 are inside the MALDI-TOF mass spectrometer 202. It should be understood that various embodiments of the apparatus of the present teaching position various combinations of the beam directing elements 218, 230 and focusing elements 222, 234 inside and/or outside of the MALDI-TOF mass spectrometer 202.

A movable target mount 240 is used move the target 212 that has the biological sample with a predetermined speed to predetermined locations relative to the axes 220, 232 of the optical beams. For example, the target mount 240 can be a mechanical translation stage that is mechanically coupled to the target 212. More particularly, in some embodiments, the target mount 240 is a moveable table equipped with motion control devices that move the biological sample with predetermined speed to predetermined locations relative to the axes of the optical beams to which a slide with a biological sample and MALDI matrix material is mounted. In some embodiments, the target mount 240 moves the target 212 to particular locations in two dimensions. In some embodiments the target mount 240 moves the target 212 to particular locations relative to the axes of the optical beams such that a two-dimensional image of the sample is formed based on a series of mass spectra measured at each location.

A controller 242 includes outputs that are electrically connected control inputs of the two lasers 214, 226, to a control input of the target mount 240, and to a control input of the MALDI-TOF mass spectrometer 202. The controller 242 is used to perform various control functions, such as to control the repetition rate, fluence, and diameter of the optical beams generated by each laser 214, 226, to control the motion of the target mount 240, and to control the operating parameters of the MALDI-TOF mass spectrometer. In some embodiments, the controller 242 also includes inputs for acquiring mass spectral data and to generate molecular images of the biological sample under measurement. In various embodiments the controller 242 can include one or several computer systems to perform these various functions.

In embodiments of the method and apparatus of the present teaching that use a transparent slide with an electrically conducting side on which the biological sample is mounted, the first optical beam 216 is projected on an axis 220 such that the beam impinges orthogonally onto the surface of the biological sample positioned adjacent to the electrically conductive side of the slide on the target 212. The first optical beam 216 is focused to a predetermined diameter at the conductive surface. The second optical beam 228 is projected on an axis 232 such that the beam impinges on the surface of the layer of MALDI matrix material deposited onto the biological sample. The beam is focused to a predetermined diameter at the surface of the layer of MALDI matrix material on the transparent slide. The axes 232, 220 are substantially coaxial. The axis 224 of the ion accelerator 204 is substantially coaxial with the axes 232, 220 of the optical beams.

In one particular embodiment, the diameter of the first optical beam 216 at the target 212 is approximately equal to twice the laser wavelength of the first optical beam 216 and the laser wavelength of the first 214 and/or the second 226 laser is 349 nm. In another particular embodiment, the diameter of the first optical beam 216 at the target 212 is approximately equal to twice the laser wavelength of the first optical beam 216 and the wavelength of the first optical beam 216 is less than 300 nm. In yet another particular embodiment, the diameter of the first optical beam 216 at the target 212 is substantially equal to twice the laser wavelength of the first optical beam 216 and the wavelength of the second optical beam 228 is greater than 300 nm.

In some embodiments, the target mount 240 moves the target 212 such that the biological sample is moved a minimum distance that is greater than the diameter of the first optical beam 216 at the sample during the time between consecutive laser pulses generated by the laser. In this way, successive laser pulses are irradiating the sample in non-overlapping regions of the sample in a nearly contiguous manner. In some embodiments, the diameter of the second optical beam 228 at the sample is substantially equal to the diameter of first optical beam 216 at the sample. Also, in some embodiments, the repetition rate of the second optical beam 228 is substantially equal to the repetition rate of first optical beam 216. Also, in some embodiments, the pulses of the second optical beam 228 are substantially coincident in time with pulses of first optical beam 216.

One feature of the methods and apparatus of the present teaching is the use of back-side illumination to energize and vaporize the sample along with the use of front-side illumination used to ionize the sample. This feature is made possible at least in part because of the use of apparatus that provides independent optical beams directing and optical beam focusing for each optical beam. In many embodiments, the apparatus precisely positions and precisely forms each of the back-side and front-side beams with predetermined dimensions using the beam directing elements 218, 230 and focusing elements 222, 234.

Figure 3:
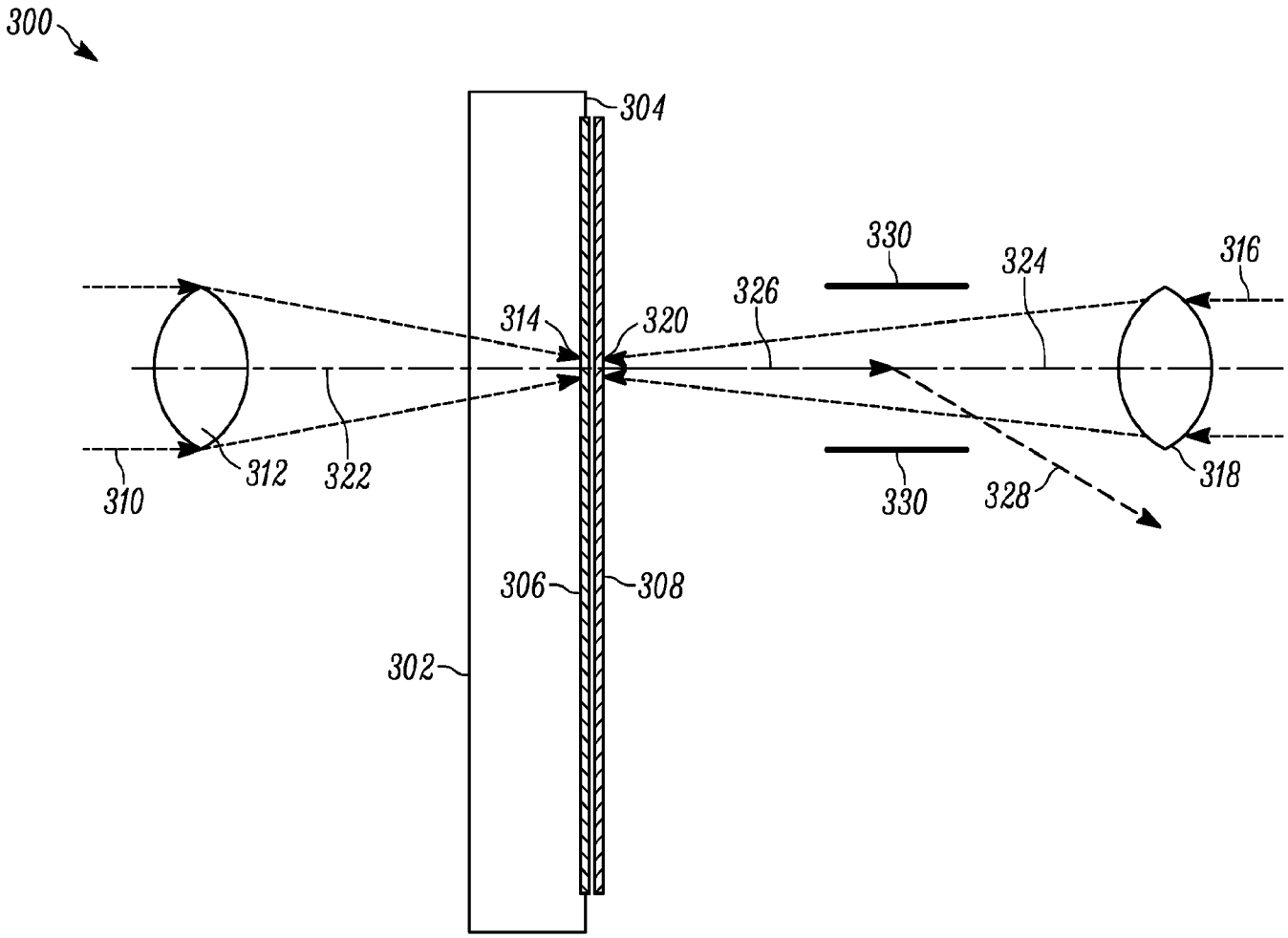
FIG. 3 illustrates a schematic of an embodiment of back-side and front-side optical beam illumination of a target according to the present teaching.

FIG. 3 illustrates a schematic of an embodiment of back-side and front-side optical beam illumination of a target 300 according to the present teaching. In this embodiment, a transparent sample plate 302 includes a conducting surface 304 on the front-side of the target 300. A thin layer of biological sample 306 is positioned on the conducting surface 304 on the front-side of the transparent sample plate 302. For example, the thin layer of biological sample 306 can be between 1 and 20 μm thick in some embodiments. In some embodiments, the thin layer of biological sample 306 is a tissue section. In some embodiments, the thin layer of biological sample 306 is substantially a monolayer of cells. A layer of MALDI matrix 308 is deposited over the sample 306. For example, the layer 308 of MALDI matrix 308 can be between 1 and 20 μm thick in some methods.

A back-side optical beam 310 is used to illuminate the back-side of the target 300. The optical beam 310 can be collimated as shown and then incident on a lens 312 that forms a focus 314 at the surface of the sample layer 306 adjacent to the electrically conductive surface 304 of the transparent sample plate.

A front-side optical beam 316 is used to illuminate the front-side of the target 300. The optical beam 316 can be collimated and then incident on a lens 318 that forms a focus 320 at the surface of the MALDI matrix layer 308.

In the particular embodiment shown in FIG. 3, a back-side optical beam axis 322, a front-side optical beam axis 324, and an ion accelerator axis 326 are all coaxial. The ions emerging from the transparent sample plate 302 are deflected to a new axis 328 after passing a set of deflection electrodes 330. It should be understood that the apparatus according to the present teaching can be configured in various optical configurations to produce optical beam diameters at the front-side focus 320 and at the backside focus 314 that achieve various desired performance metrics, such as resolution, efficiency, and or speed of generating the image.

Figure 4:
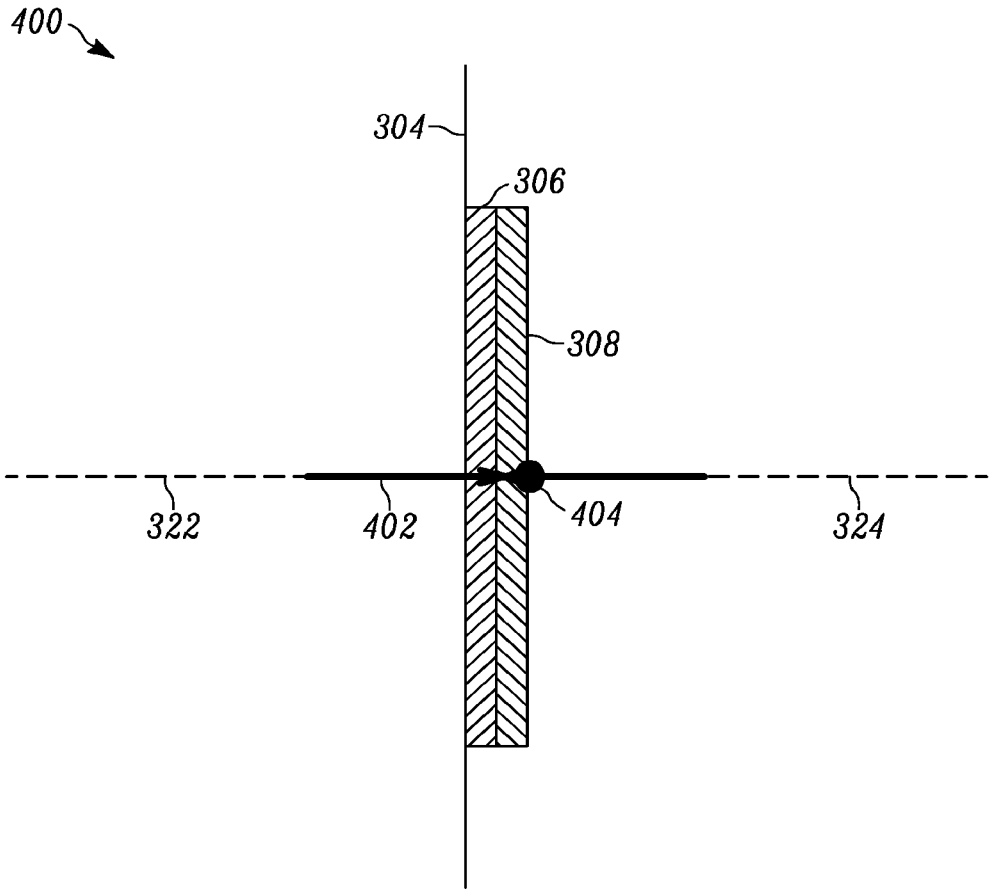
FIG. 4 illustrates an expanded-view of the schematic of the embodiment of back-side and front-side optical beam illumination of the target described in connection with FIG. 3.

FIG. 4 illustrates an expansion of the schematic of the embodiment of back-side and front-side optical beam illumination 400 of the target described in connection with FIG. 3. The expansion of the schematic in FIG. 4 shows the conducting surface 304, the thin layer of sample 306, and the layer of MALDI matrix 308 deposited on the sample 306. The axes 322, 324 for front-side and backside optical beams are shown. The expansion of the schematic in FIG. 4 also shows how the back-side optical beam penetrates the sample 306 layer with the arrow 402. In addition, the expansion of the schematic in FIG. 4 shows the back-side optical beam intersecting at circle 404 with the front-side optical beam. At this intersection, a superheated plasma containing sample and matrix is expelled for time-of-flight measurement.

EQUIVALENTS

While the Applicant's teaching is described in conjunction with various embodiments, it is not intended that the Applicant's teaching be limited to such embodiments. On the contrary, the Applicant's teaching encompass various alternatives, modifications, and equivalents, as will be appreciated by those of skill in the art, which may be made therein without departing from the spirit and scope of the teaching.

What is claimed is:

1. An apparatus for molecular imaging of biological samples, the apparatus comprising:

a) a first optical port configured to receive a first pulsed optical beam that is directed in an optical path along an optical axis;

b) a transparent target positioned in the optical path along the optical axis, the transparent target comprising a first surface having an electrically conductive surface that supports a biological sample under analysis and a second surface;

c) a moveable target mount that is mechanically attached to the transparent target and configured to translate the transparent target to a plurality of predetermined locations;

d) a first optical focusing element positioned in the optical path along the optical axis and configured to focus the first pulsed optical beam to a first predetermined diameter at the first surface of the transparent target having the electrically conductive surface that supports the biological sample under analysis;

e) a second optical port configured to receive a second pulsed optical beam that is directed in a second optical path along the optical axis;

f) a second optical focusing element positioned in the second optical path along the optic axis and configured to focus the second pulsed optical beam to a second predetermined diameter at the electrically conductive surface on the transparent target that supports the biological sample under analysis;

g) a time-of-flight mass spectrometer comprising an ion accelerator having a central axis that is substantially coaxial with the optical axis so that ions generated by the first and second pulsed optical beams are accelerated by the ion accelerator; and h) a controller having an output that is electrically connected to a control input of the time-of-flight mass spectrometer and having a second output that is electrically connected to a control input of the transparent target stage, wherein the controller instructs the time-of-flight mass spectrometer to acquire mass spectral data at the plurality of predetermined locations, thereby generating a molecular image of the biological sample under analysis.

2. The apparatus for molecular imaging of biological samples of claim 1 wherein the transparent target comprises a transparent slide.

3. The apparatus for molecular imaging of biological samples of claim 1 wherein the mass spectrometer comprises a MALDI-TOF mass spectrometer.

4. The apparatus for molecular imaging of biological samples of claim 1 wherein the moveable target mount is configured to translate the transparent target to a plurality of predetermined locations in a plane wherein a normal of the plane is directed parallel to the optical axis.

5. The apparatus for molecular imaging of biological samples of claim 4 wherein a minimum distance between at least two of the plurality of predetermined locations in the plane is a distance greater than the first predetermined diameter of the first pulsed optical beam.

6. The apparatus for molecular imaging of biological samples of claim 4 wherein a time between consecutive pulses of the first and second pulsed optical beams is equal to a time to translate the transparent target to the at least two of the plurality of predetermined locations in the plane.

7. The apparatus for molecular imaging of biological samples of claim 1 further comprising a pulsed laser that generates the first pulsed optical beam.

8. The apparatus for molecular imaging of biological samples of claim 1 wherein the first predetermined diameter of the first pulsed optical beam is substantially equal to twice a wavelength of the first pulsed optical beam.

9. The apparatus for molecular imaging of biological samples of claim 8 wherein the wavelength of the first pulsed optical beam is approximately 349 nm.

10. The apparatus for molecular imaging of biological samples of claim 1 wherein the predetermined diameter of the second pulsed optical beam is substantially equal to the predetermined diameter of the first pulsed optical beam.

11. The apparatus for molecular imaging of biological samples of claim 1 wherein a repetition rate of the second pulsed optical beam is substantially equal to a repetition rate of first pulsed optical beam.

12. The apparatus for molecular imaging of biological samples of claim 1 wherein a pulse of the second pulsed optical beam is substantially coincident in time with a pulse of the first pulsed optical beam.

13. The apparatus for molecular imaging of biological samples of claim 1 wherein a wavelength of the first pulsed optical beam is less than 300 nm.

14. The apparatus for molecular imaging of biological samples of claim 1 wherein a wavelength of the second pulsed optical beam is greater than 300 nm.

15. The apparatus for molecular imaging of biological samples of claim 7 further comprising a second pulsed laser that generates the second pulsed optical beam.

16. The apparatus for molecular imaging of biological samples of claim 1 further comprising a first optical beam directing element positioned in a path of the first optical beam and configured to project the first optical beam along an optical axis.

17. The apparatus for molecular imaging of biological samples of claim 1 further comprising a second optical beam directing element positioned in a path of the second optical beam and configured to project the second optical beam along the optical axis.

18. A method for molecular imaging of biological samples, the method comprising:

a) directing a first pulsed optical beam in an optical path along an optical axis;

b) positioning a transparent target comprising a first surface having an electrically conductive surface that supports a biological sample under analysis in the optical path along the optical axis;

c) focusing the first pulsed optical beam in the optical path along the optical axis to a first predetermined diameter at the first surface of the transparent target comprising the electrically conductive surface that supports the biological sample under analysis;

d) directing a second pulsed optical beam to the transparent target in an optical path along the optical axis;

e) focusing the second pulsed optical beam in the optical path along the optical axis to a second predetermined diameter at the first surface of the transparent target comprising the electrically conductive surface that supports the biological sample under analysis;

f) acquiring time-of-flight mass spectral data from ions generated from the first and second pulsed optical beams at a central axis of a time-of-flight mass spectrometer that is substantially coaxial with the optic axis;

g) translating the transparent target to one of a plurality of predetermined locations; and h) repeating steps f) and g) to generate a molecular image of the biological sample under analysis.

19. The method of claim 18 wherein the time-of-flight mass spectral data is acquired by using a MALDI-TOF mass spectrometer.

20. The method of claim 19 further comprising depositing a layer of MALDI matrix material on the biological sample under analysis.

21. The method of claim 20 wherein the layer of MALDI matrix material has a thickness that is between 1 and 20 μm.

22. The method of claim 20 wherein the layer of MALDI matrix material is positioned directly on the electrically conductive surface and the biological sample under analysis is deposited onto the surface of the MALDI matrix.

23. The method of claim 18 wherein the biological sample under analysis has a thickness that is between 1 and 20 μm.

24. The method of claim 18 wherein the biological sample under analysis comprises a tissue section.

25. The method of claim 24 wherein a thickness of the tissue section is between 1 and 20 μm.

26. The method of claim 18 wherein the biological sample under analysis comprises a substantially monolayer of cells.

27. The method of claim 18 wherein the translating the transparent target to one of a plurality of predetermined locations comprises translating the transparent target to a plurality of predetermined locations in a plane wherein a normal of the plane is directed parallel to the optical axis.

28. The method of claim 27 wherein a minimum distance between at least two of the plurality of predetermined locations in the plane is a distance greater than the first predetermined diameter of the first pulsed optical beam.

29. The method of claim 27 wherein a time between consecutive pulses of the first and second pulsed optical beams is equal to a time to translate the transparent from one of the plurality of predetermined locations to another of the plurality of predetermined locations.

30. The method of claim 18 wherein the first predetermined diameter of the first pulsed optical beam is substantially equal to twice a wavelength of the first pulsed optical beam.

31. The method of claim 30 wherein the wavelength of the first pulsed optical beam is approximately 349 nm.

32. The method of claim 18 wherein the predetermined diameter of the second pulsed optical beam is substantially equal to the predetermined diameter of the first pulsed optical beam.

33. The method of claim 18 wherein a repetition rate of the second pulsed optical beam is substantially equal to a repetition rate of first pulsed optical beam.

34. The method of claim 18 wherein a pulse of the second pulsed optical beam is substantially coincident in time with a pulse of the first pulsed optical beam.

35. The method of claim 18 wherein a wavelength of the first pulsed optical beam is less than 300 nm.

36. The method of claim 18 wherein a wavelength of the second pulsed optical beam is greater than 300 nm.

* * * * *